United States Patent [19]

Nolte et al.

[11] 4,393,933

[45] Jul. 19, 1983

[54] DETERMINATION OF MAXIMUM FRACTURE PRESSURE

[75] Inventors: Kenneth G. Nolte; Michael B. Smith, both of Tulsa, Okla.

[73] Assignee: Standard Oil Company (Indiana), Chicago, Ill.

[21] Appl. No.: 251,666

[22] Filed: Apr. 6, 1981

Related U.S. Application Data

[63] Continuation of Ser. No. 155,873, Jun. 20, 1980, abandoned.

[51] Int. Cl.[3] ..... E21B 49/00

[52] U.S. Cl. ..... 166/250; 166/308

[58] Field of Search ..... 166/250, 308, 259, 281

[56] References Cited

U.S. PATENT DOCUMENTS

| | | | |
|---|---|---|---|
| 3,739,871 | 6/1973 | Bailey | 166/308 |
| 3,743,017 | 7/1973 | Fast et al. | 166/308 |
| 3,917,345 | 11/1975 | Davidson | 166/280 |
| 4,005,750 | 2/1977 | Shuck | 166/250 |
| 4,044,828 | 8/1977 | Jones et al. | 166/250 |

*Primary Examiner*—William F. Pate, III

*Attorney, Agent, or Firm*—Scott H. Brown; Fred E. Hook

[57] ABSTRACT

During injection of fracture fluid into a subterranean formation, the bottomhole treating pressure at which the change in pressure is essentially zero is determined. This pressure is the maximum which should be attained for that formation during fracture and is useful for designing subsequent fracture treatments within the same subterranean formation.

8 Claims, 2 Drawing Figures

DETERMINATION OF MAXIMUM FRACTURE PRESSURE

This is a continuation, of application Ser. No. 155,873, filed June 2, 1980 abandoned.

BACKGROUND OF THE INVENTION

1. Field of the Invention

The method of this invention relates to hydraulic fracturing of a subterranean formation by a fracturing fluid. Particularly, this invention relates to the design of techniques and selection of materials for fracturing a formation. More particularly, this invention relates to a method for interpreting bottomhole fracturing pressure of a formation and the use of such interpretations for alteration and design of such techniques.

2. Setting of the Invention

Oil and gas accumulations usually occur in porous and permeable underground rock formations. In order to produce the oil and gas contained in a formation, a well is drilled into the formation. The oil and gas may be contained in the porosity or pore spaces of the formation, hydraulically connected by means of permeability or interconnecting channels between the pore spaces. After the well is drilled into the formation, oil and gas are displaced to the wellbore by means of fluid expansion, natural or artificial fluid displacement, gravity drainage, capillary expulsion, etc. These various processes may work together or independently to move the hydrocarbons into the wellbore through existing flow channels. In many instances, however, production of the well may be impaired by drilling fluids that enter into and plug 4 the flow channel 5, or is unsatisfactory due to insufficient natural channels leading into the particular bore hole or insufficient permeability surrounding the borehole which may result in a noncommercial well. The problem then becomes one of treating the formation in a manner which will increase the ability of a formation rock to conduct fluid to the wellbore.

Various methods of hydraulically fracturing a formation to increase the conductivity of the formation have been developed. Hydraulic fracturing may be defined as a process in which fluid pressure is applied to exposed formation rock until total failure or fracturing occurs. After failure of the formation rock, a sustained application of fluid pressure extends the crevice or fracture outward from the point of failure. The fracture, held open by a proppant, creates a high capacity flow channel and exposes new surface area along the fracture. Although dependent upon overburden pressure, fractures below about 3000 feet are generally vertical. The method of this invention is most useful, is not solely, in generation of vertical fractures.

It is desirable in forming such vertical fractures that the height of such a vertical fracture should be confined to approximately the zone of interest to maximize the length of the fracture formed with the fluid injected or time expended. One method of controlling height during vertical fracturing includes maintaining a low pumping rate. Use of low rates alone may not necessarily alleviate undesirable fracturing which can occur at high bottomhole treating pressures and does require longer than normal fracturing times.

SUMMARY OF THE INVENTION

A method applicable to formation of a vertical fracture in a subterranean formation is described for determining a maximum bottomhole treating pressure which should be attained during fracturing of the subterranean formation at a first wellbore extending into the formation comprising: extending the fracture into the formation from a second wellbore by injecting fluid into the fracture at a rate sufficient to extend the fracture into the formation until the change in bottomhole treating pressure is substantially zero; measuring at the second wellbore the bottomhole treating pressure, determining the bottomhole treating pressure at which the change in bottomhole treating pressure during the formation of the fracture extending from the second wellbore is substantially zero, and taking the sum of this determined bottomhole treating pressure less the in situ closure pressure of the formation at the second wellbore plus the in situ closure pressure of the formation at a first wellbore extending into the formation as the maximum bottomhole treating pressure which should be attained during the fracturing of the formation at the first wellbore.

A method is also described which is applicable to formation of vertical fractures in which the difference between the bottomhole treating pressure and closure pressure of first wellbore is measured and the difference at which the change in the difference is substantially zero is determined and added to the closure pressure for a second wellbore, thus determining a maximum bottomhole treating pressure for fracturing a formation surrounding the second wellbore.

DETAILED DESCRIPTION OF THE INVENTION

Figure 1:
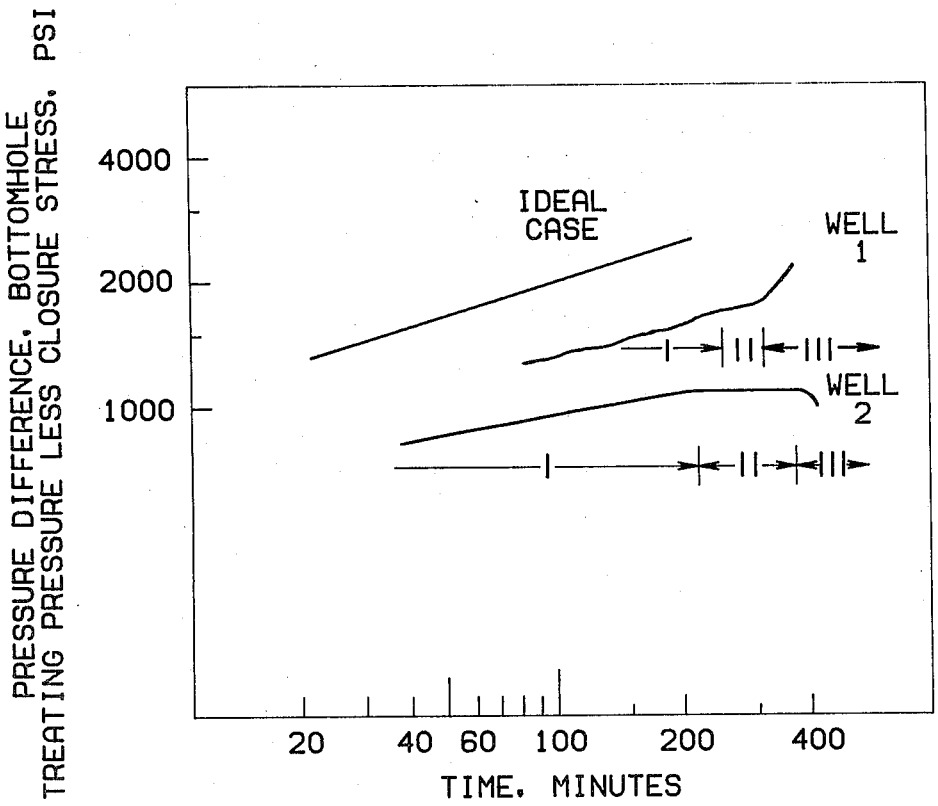
FIG. 1 is a log-log plot showing bottomhole treating pressure less fracture closure stress versus time for an ideal well and two wells used for determining the subsequent maximum bottomhole treating pressure which should be attained during fracturing of a formation at wellbores extending into the formation.

In the fracturing of a subterranean formation, prevention of rapid height growth and maintenance of effective length extension or a high rate of fracture length extension in proportion to the amount of fluid introduced into the fracture requires alteration, in most larger treatments, of the rate at which the fracture fluid is injected into the fracture and the selection of the proper type of fracture fluid to be used. By knowing the pressure at which the rate of length extension is reduced, the rate of injection can be tapered off to a ratio of the initial rate to final rate ranging from about 5:4 to about 5:1, as this pressure is approached to achieve maximum fracture extension. Preferred range would be 3:2 to 3:1. The type of fracturing fluid can be selected to achieve a maximum fracture length. The viscosifier concentration may also be tapered off as this pressure is approached, the ratio of maximum concentration to final concentration ranges from about 3:2 to about 5:1. Typically, the initial concentration is less than the maximum concentration, the ratio of initial to maximum concentration being about 2:3. Determination of this maximum pressure to which a formation should be subjected during a fracturing treatment as well as characteristics of subterranean formation, is difficult to simulate in the laboratory evaluations of a formation. Simulation difficulties and the uncertainty associated therewith are alleviated by the method of this invention whereby the maximum pressure to which a formation should be subjected during a fracture treatment is determined.

Interpretation of bottomhole treating pressure yields identification of three different modes of fracture extension during hydraulic fracturing. These modes include (a) confined height extension wherein the extension of the fracture is fairly constant with fracture time and volume of fluid injected, (b) reduced fracture extension rate wherein the fracture extension rate significantly decreases with respect to time and volume of fluid injected and (c) undesirable fracturing wherein effects such as screenout of proppants lead to fracture bridging by the proppant, undesirable fracture height growth, excessive fluid loss and potentially undesirable secondary fracture openings occur.

Confining the height of the fracture to the zone of interest is desirable to limit expenditure of fracture fluid to the zone of interest and to avoid breaking into zones containing water or having undesirable secondary fracturing or production characteristics. Continued fracture fluid injection beyond the determined maximum pressure generally causes the fracture treatment to move into the undesirable fracturing mode. The determined maximum for one wellbore pressure is useful in designing subsequent treatments within the same subterranean formation and for altering on a real time basis the continuing fracture treatment in which maximum pressure has been determined. The above design techniques for subsequent fracture treatments is particularly useful in formations where the potential exists for large drilling and treatment expenditures.

The pressure which a formation will be subjected to during the formation of a fracture is referred to as the bottomhole treating pressure and is the pressure at the entrance to the fracture as measured inside the casing or inferred by methods known to persons skilled in the art of hydraulic fracturing. Bottomhole treating pressure is used as opposed to the surface injection pressure due to pressure differences caused by viscosity and/or large fluid friction losses in the tubing or casing. Preferably, the casing does not cover the zone to be treated or is sufficiently perforated such that the pressure drop across the casing is negligible and the bottomhole treating pressure is essentially the same as the pressure at the entrance of the fracture outside the casing.

By the method of this invention, a process is described for determining the maximum pressure to which a formation should be subjected during the formation of a fracture. A hydraulic fracture treatment is conducted on a subterranean formation. The bottomhole treating pressure of the fluid is measured during the formation of the fracture. The in situ closure stress or pressure of the formation is determined by methods known to persons skilled in the art of hydraulic fracturing. The closure pressure is generally constant during a treatment within most low permeability areas requiring massive hydraulic fracturing. Notable variations in closure stress during a treatment may be found in formations having high permeability. The method of this invention also affords well operators with a forecast of the time at which shut-down should occur, which in turn provides an opportunity to purge or flush the tubing or casing of the proppant-laden fluid prior to shutdown.

For hydraulically created fractures which are in an essentially vertical plane and have a confined or limited vertical height growth and negligible slip of the boundaries along the horizontal planes which intersect the fracture, the bottomhole treating pressure above closure pressure increases continuously proportionately with time raised to an exponent; i.e., $$P(t) \propto t^{e}, \tag{1}$$

wherein P is the the difference between the bottomhole treating pressure and the in situ closure pressure, t is the treating time or accumulated value of injected fluid and e generally varies between 0.125 and 0.25, depending on the fluid rheology and the fluid loss at constant injection rate to the formation.

An ideal curve is produced for the case wherein the t is raised to the 0.25 power and is shown in the FIG. 1.

The reduction in fracture extension rate may be explained by use of two basic relationships (a) fluid flow (i.e., equation 2) and (b) continuity (i.e., equation 4). The bottomhole treating pressure above an in situ closure stress at a constant height, constant flow rate down the fracture (not physically possible due to leakoff and storage), and constant viscosity properties can be shown to be similar to a case in which flow rate and viscosity increase from the fracture tip to the wellbore, and is expressed as the proportionality of:

$$P \propto \left[ \frac{k_o Q_o^n L}{H^n C^{2n+1}} \right]^{1/(2n+2)} \tag{2}$$

wherein H is the height of the fracture, L is the length of the fracture, $k_o$ is the power-law coefficient of the fluid at the wellbore (proportional to the viscosity), $Q_o$ is the flow rate of fluid within the fracture at the wellbore, C is the fracture compliance, and n is the power law exponent for the fracture fluid.

Fracture compliance is defined as:

$$C = W/P \tag{3}$$

wherein P is the local fracture pressure above the in situ closure pressure stress and W is the local fracture width.

The continuity equation for a fraction can be expressed as follows:

$$Q_o = \lambda + (dV/dt), \tag{4}$$

wherein λ is the fluid loss rate of the fracture fluid to the formation, V is the fracture volume, and t is time since the fracture was activated and fluid was continuously being injected into the fracture.

Substituting V=LWH and using 3, wherein all variables denote their average value over the fracture length, $$V = LPCH \tag{5}$$

Substituting 5 into 4 and expressing the results with respect to the incremental changes during the time Δt, yields $$Q_o = \lambda + LPCH\left( \frac{\Delta L}{L} + \frac{\Delta P}{P} + \frac{\Delta C}{C} + \frac{\Delta H}{H} \right) \frac{1}{\Delta t} \tag{6}$$

For a constant injection rate $Q_o$, the right-hand side of 6 is constant and places a restriction on the permissible changes in the variables with respect to each other. As a consequence, any positive increase in P, C, or H results in a decrease in the potential rate of length extension, L. In addition to 6, 2 places a restriction on the permissible changes in the variables.

When $\Delta P=0$, pressure is no longer increasing as required by 1, in the idealized case for this condition no stringent requirements are placed on the other variables in 6 or 2. However, 6 does imply that since the rate of pressure increase is less than that rate under extension of a confined fracture height, the other variables must increase at a greater rate. A larger rate of change of length, L, that for the treatment resulting in confined height extension is possible under 6 if the other variables do not change, but this is not compatible with 2. 2 implies that if $\Delta P=0$, L cannot increase if neither height nor compliance increases. To be compatible with 1 and 6, fluid loss, height, compliance, or length must be increasing at a rate greater than before. Height or compliance increases are not incompatible with 6. Therefore, for $\Delta P=0$ the rate of extension is probably less than that for the extension with confined height, and fluid loss, height or compliance is changing at a greater rate.

Therefore, the reduction is fracture extension rate which because of increases in fluid loss, height growth, or fracture compliance over that occurring during confined height extension results in a constant difference between bottomhole treating pressure and in situ closure pressure with respect to time or volume of injected fluid. Hence, once the constant pressure region is known for one well within a subterranean formation, subsequent wells with this formation may be fractured by limiting the bottomhole treating pressure to below the known pressure which causes reduced fracture extension. Practically, the method of this invention is useful for formations which are subjected to massive hydraulic treatments where length of penetration is a multiple of fracture height.

The lower practical rate of fracture fluid injection is determined by engineering practices known to those skilled in the art of producing fractures in subterranean formations. Preferably, the pumping rate is sufficient to eliminate changes in closure stress due to high fluid losses which may cause increased pore pressure. A constant rate of injection is perferred during determination of the maximum pressure.

EXAMPLE I

An 8395 ft well, located in the Wattenberg Field of the Denver Basin was fractured by pumping 7810 bbls of fracturing fluid carrying 620,000# of coarse sand (20–40 mesh) as a proppant at a rate of 20 bbls/min into the fracture. The fracturing fluid was pumped into the fracture for approximately 390 minutes and consisted of 60# cross linked polymer/1000 gals of water.

The fracture closure pressure of the formation at this location is estimated at about 4600 psi (bottomhole pressure).

EXAMPLE II

A second well in the Carthage Field of East Texas was fractured at a depth of 9530 feet by pumping 7300 bbls of fracturing fluid with 839,000# of proppant at a rate of 19 bbls/min into the fracture. The fracturing fluid was pumped into the fracture and consisted of 60# of cross linked polymer per 1000 gals of water for 100 minutes, 50# for 200 minutes, and 40# for 90 minutes. The fracture closure pressure of the formation at this location is about 6625 psi (bottomhole) determined by a pump and flow back procedure. This procedure is disclosed in Nolte, K. G., "Determination of Fracture Parameters from Fracturing Pressure Decline", 54th Annual Technical conference and Exhibition (Society of Petroleum Engineers of AIME), Las Vegas (September 1979).

The bottomhole treating pressure for these two wells is the sum of the surface pressure, as determined by a tubing annulus wellbore configuration method having no packer, and the hydrostatic pressure. The above treatments were pumped at a substantially constant rate during a pumping period.

The bottomhole treating pressure above the in situ closure stress (i.e., pressure) as a function of time is presented for each treatment on a log-log plot in FIG. 1. The initial periods of data are not shown because they contain periods of significant deviation from a constant injection rate and/or significant variation in the viscosity of the injected fluid.

The bottomhole treating pressure for the respective wells of Examples I and II are plotted in FIG. 1 to illustrate three regions. Region I shows slopes which coincide with the ideal case (i.e., case representations of equation 1) also shown in FIG. 1 and would therefore represent that mode of the treatment which would be classed as confined height and unrestricted extension. Region II shows a rate of pressure change equaling zero and would represent a reduction in extension rate. Region III shows significant changes in the rate of pressure change which would be indicative of indesirable fracturing.

In Well 1, the positive 1:1 slope of Region III indicates that both tips of the fracture have reached a fracture barrier, e.g., the proppant has bridged the fracture and therefore the pressure increase is due to an increase in fracture width.

In Well 2, the negative slope of Region III indicates that the fracture fluid has broken into a zone of lower in situ closure stress which would divert the fracture fluid into the lower stressed pressure formation. Preferred fracture extension in both wells ceases at the initiation of Region II.

For Well 1, the Region II bottomhole treating pressure less closure stress was determined to be 1700 psi and for Well 2, 1150 psi. The pressure differences thus determined may be used in designing subsequent fracturing treatments in the respective formations.

EXAMPLE III

Using the pressure difference from Well #2, a fracturing treatment was designed for a well (Well #3) located in the Carthage Field. The well was fractured by pumping 33 bbls/min for 25 minutes. 30 bbls/min for 35 minutes. 28 bbls/min for 10 minutes, 25 bbls/min for 20 minutes 22 bbls/min for 15 minutes, and 20 bbls/min for 115 minutes. The fracture fluid concentration was also tapered as the pressure approached 1150 psi. The concentrations were 50# polymer gel/1000 gal of $H_2O$ for 38 minutes. 60# for 52 minutes, 50# for 45 minutes. 40# for 40 minutes, and 30# for 45 minutes.

Figure 2:
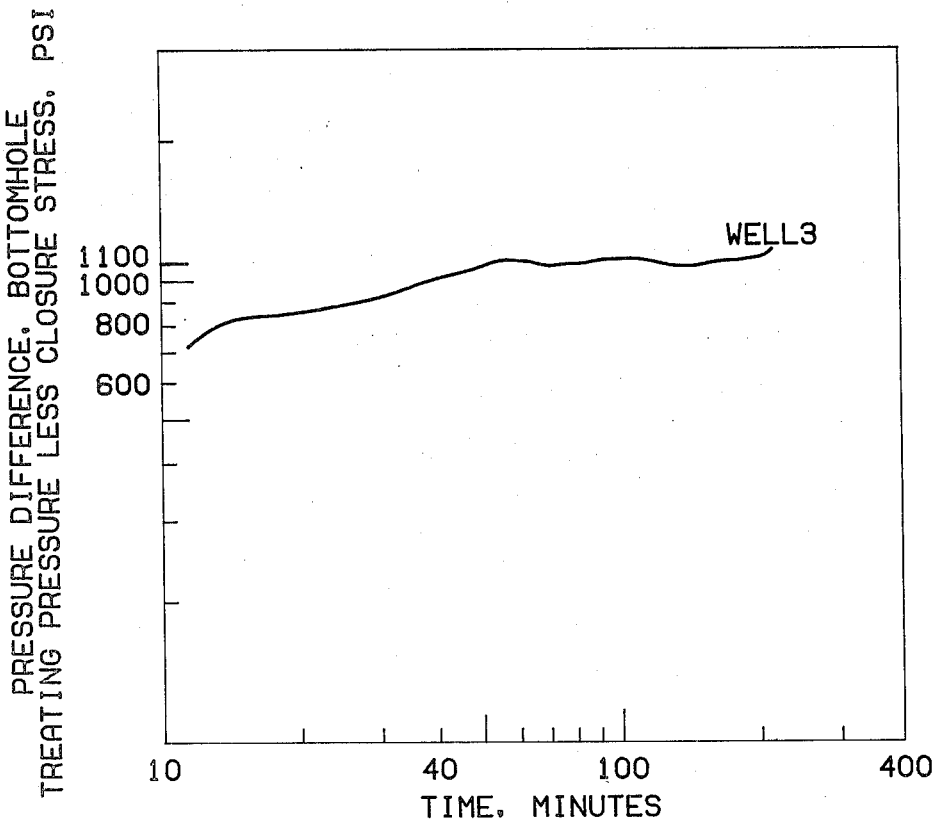
FIG. 2 is a log-log plot showing bottomhole treating pressure less fracture closure stress versus time for a well using the maximum pressure determined from FIG. 1.

The bottomhole pressure less the closure stress for Well #3 is shown in FIG. 2. The injection was discontinued after 220 minutes when the fracture was estimated to be at least as effective as that of Well #2. Using the bottomhole treating pressure less closure stress of Well #2 1 allowed reduction of pumping time on Well #3 by 170 minutes (45% reduction) and the amount of fracturing fluid by 2560 bbl of fluid (33% reduction). The estimated vertical height of the fracture was reduced from about 240 to about 160 feet.

While certain embodiments of the invention are described, the invention is not limited thereto. Various modifications or embodiments of the invention will be apparent to those skilled in the art in view of this disclosure and such modifications or embodiments are within the spirit and scope of this disclosure.

We claim:

1. A method of determining the maximum bottomhole treating pressure which should be attained during the fracturing of a subterranean formation at a first wellbore extending into the formation, which comprises extending a fracture into the formation from a second wellbore extending into the formation by injecting fluid into the fracture at a rate sufficient for extending said fracture into the formation until the change in the bottomhole treating pressure is substantially zero during the injection of the fluid, measuring at the second wellbore the bottomhole treating pressure, determining the bottomhole treating pressure at which the change in bottomhole treating pressure during the formation of the fracture extending from the second wellbore is substantially zero, and taking the sum of said determined bottomhole treating pressure less the in situ closure stress of the formation at the second wellbore plus the in situ closure stress of the formation at a said first wellbore extending into the formation as the maximum bottomhole treating pressure which should be attained during the fracturing of the formation at said first wellbore.

2. A method of determining the maximum bottomhole treating pressure which should be attained during the fracturing of a subterranean formation at a first wellbore extending into said formation, which comprises:

injecting a fluid into a second wellbore extending into said formation at a rate sufficient to extend a fracture into said formation from said second wellbore until the change in the difference between bottomhole treating pressure of said second wellbore and closure pressure of said formation at said second wellbore is substantially zero during said fluid injection, measuring the difference between bottomhole treating pressure of said second wellbore and closure pressure of said formation at said second wellbore, determining the difference between bottomhole treating pressure of said second wellbore and closure pressure of said formation at said second wellbore at which the change in the difference between bottomhole treating pressure of said second wellbore and closure pressure of said formation at said second wellbore during said fluid injection into said second wellbore is substantially zero, and taking the sum of said determine difference between bottom hole treating pressure at said second wellbore and closure pressure of said formation at said second wellbore and the in situ closure pressure of said formation at said first wellbore as the maximum bottomhole treating pressure which should be attained during said fracturing of said formation at said first wellbore.

3. The method of claim 4, 5, 6 or 7 wherein said fluid injection is continued until said pressure difference increases significantly.

4. The method of claim 1 or 2 wherein said fluid injection is continued until said pressure difference decreases.

5. The method of claim 1 or 2 wherein said injection of fracturing fluid into said formation is at a constant rate.

6. A method for hydraulic fracturing of an underground formation through a first wellbore extending into said formation comprising:

(a) determining at a second wellbore extending into said formation a maximum pressure to extend a fracture into the formation without undesirable fracturing effects, such as screen out of proppants, undesirable fracture height growth, excessive fluid loss and the like;

(b) treating said first well with a hydraulic fracture treatment so that the bottomhole pressure during the fracture treatment does not exceed the maximum pressure determined in the second wellbore.

7. A method of claim 6 wherein step (a) is performed by a method comprising:

(a) extending a fracture into the formation from a second wellbore extending into the formation by injecting fluid into the fracture at a rate sufficient for extending said fracture into the formation until the change in the bottomhole treating pressure is substantially zero during the injection of the fluid;

(b) measuring at the second wellbore the bottomhole treating pressure;

(c) determining the bottomhole treating pressure at which the change in bottomhole treating pressure during the formation of the fracture extending from the second wellbore is substantially zero; and (d) taking the sum of said determined bottomhole treating pressure less the in situ closure stress of the formation at the second wellbore plus the in situ closure stress of the formation at said first wellbore extending into the formation as the maximum bottomhole treating pressure which should be obtained during the fracturing of the formation of said first wellbore.

8. A method of claim 6 wherein step (a) is performed by a method comprising:

(a) injecting a fluid into a second wellbore extending into said formation at a rate sufficient to extend a fracture into said formation from said second wellbore until the change in the difference between bottomhole treating pressure of said second wellbore and closure pressure of said formation at said second wellbore is substantially zero during said fluid injection;

(b) measuring the difference between the bottomhole treating pressure of said second wellbore and closure pressure of said formation at said second wellbore;

(c) determining the difference between the bottomhole treating pressure of said second wellbore and closure pressure of said formation at said second wellbore at which the change in the difference between bottomhole treating pressure of said second wellbore and closure pressure of said formation at said second wellbore during said fluid injection into said second wellbore is substantially zero; and (d) taking the sum of said determined difference between bottomhole treating pressure at said second wellbore and closure pressure of said formation at said second wellbore and the in situ closure pressure of said formation at said first wellbore as the maximum bottomhole treating pressure which should be obtained during said fracturing of said formation at said first wellbore.

* * * * *

UNITED STATES PATENT OFFICE
CERTIFICATE OF CORRECTION

PATENT NO. : 4,393,933

DATED : July 19, 1983

INVENTOR(S) : Kenneth B. Nolte and Michael B. Smith

It is certified that error appears in the above-identified patent and that said Letters Patent are hereby corrected as shown below:

Column 1, line 34, delete "4" after "plug"; change "channel" to --channels--; delete "5" after "channels"; line 53, "is" should be --if--;

Column 4, line 13, "value" should be --volume--; line 46, "fraction" should be --fracture--;

Column 5, line 26, "is" should be --in--;

Column 6, line 33, "indesirable" should be --undesirable--;

Column 8, Claim 3, line 1, "claim 4, 5, 6 or 7" should be --claim 1 or 2--; line 44, "of" should be --at--.

Signed and Sealed this

*Twenty-sixth* Day of *March 1985*

[SEAL]

*Attest:*

DONALD J. QUIGG

*Attesting Officer* *Acting Commissioner of Patents and Trademarks*